US006508410B1

(12) United States Patent
Thomas, Jr. et al.

(10) Patent No.: US 6,508,410 B1
(45) Date of Patent: Jan. 21, 2003

(54) SPRAYER RETAINING CLIP AND METHOD

(75) Inventors: James G. Thomas, Jr., Simpsonville, SC (US); Harold S. Phipps, Easley, SC (US)

(73) Assignee: Package Supply & Equipment Co., Inc., Greenville, SC (US)

( * ) Notice: Subject to any disclaimer, the term of this patent is extended or adjusted under 35 U.S.C. 154(b) by 0 days.

(21) Appl. No.: 09/657,822

(22) Filed: Sep. 8, 2000

(51) Int. Cl.[7] ..... B05B 9/043

(52) U.S. Cl. ..... 239/1; 239/282; 239/283; 239/333; 239/373; 239/588; 239/526; 222/530; 222/538; 248/75

(58) Field of Search ..... 239/152, 154, 239/282, 283, 333, 373, 525, 526, 530, 587.1, 588, 600, 1; 248/75, 79, 316.7, 309.1, 313, 315; 222/382, 383.1, 383.2, 527, 529, 530, 538; 220/735

(56) References Cited

U.S. PATENT DOCUMENTS

| | | | | | |
|---|---|---|---|---|---|
| 1,039,335 | A | | 9/1912 | Tyler | |
| 1,279,006 | A | * | 9/1918 | Rose | 248/75 |
| 1,566,597 | A | | 12/1925 | Harman | |
| 1,611,259 | A | | 12/1926 | Wogenstahl | |
| 2,641,385 | A | | 6/1953 | Rives | |
| 2,741,406 | A | | 4/1956 | Matson | |
| 2,987,228 | A | | 6/1961 | Matson | |
| 3,653,556 | A | * | 4/1972 | Moran et al. | 222/530 |
| 3,865,310 | A | * | 2/1975 | Elkins et al. | 239/588 |
| 3,979,096 | A | * | 9/1976 | Zieger | 248/75 |
| 4,446,994 | A | | 5/1984 | Smith | |
| 4,903,922 | A | * | 2/1990 | Harris, III | 248/75 |
| 5,005,790 | A | * | 4/1991 | Harris, III | 248/75 |
| 5,058,783 | A | | 10/1991 | Antonelli | |
| 5,107,909 | A | | 4/1992 | Donovan | |
| 5,544,783 | A | * | 8/1996 | Conigliaro | 220/735 |
| 5,584,345 | A | | 12/1996 | Joy | |
| 5,676,314 | A | * | 10/1997 | Brass et al. | 239/154 |
| 5,887,767 | A | | 3/1999 | Riley et al. | |
| 6,050,459 | A | * | 4/2000 | Johnson et al. | 222/530 |
| 6,102,258 | A | * | 8/2000 | Riley et al. | 222/538 |
| 6,311,936 | B1 | * | 11/2001 | Herr et al. | 248/75 |

* cited by examiner

*Primary Examiner*—Steven J. Ganey
(74) *Attorney, Agent, or Firm*—Dority & Manning, P.A.

(57) ABSTRACT

A mounting member (A) is carried beneath a closure member at the top of a liquid container positioning a receiving member (B) in opposed cantilevered relation thereby providing a lateral passageway (C) for accommodating a liquid dispensing tube so that a sprayer may be carried in upright position in the receiving member.

13 Claims, 2 Drawing Sheets

SPRAYER RETAINING CLIP AND METHOD

BACKGROUND OF THE INVENTION

This invention relates to retaining apparatus and method especially useful for receiving and carrying a garden sprayer positioned at one end of a liquid dispensing tube when not in use.

A mounting ring member is carried adjacent a closure cap member at the top of a liquid container for mounting a receiving carrier member extending in cantilevered relation outwardly therefrom for carrying the sprayer. The tube is afforded entrance within the receiving member through a lateral passageway.

The invention is described in connection with garden sprayers wherein a flexible liquid dispensing tube extends downwardly therefrom through a closure member into a liquid container. The usefulness of garden sprayers is limited by the fact that it is undesirable to withdraw the tube from the container during periods of non use. Since the sprayer and the nozzle remain connected to the dispensing tube they may tip over spilling the liquid contents during periods of non use. This problem also persists in connection with dispensing other liquids from liquid containers provided with dispensing tubes. In addition to insecticides and fertilizers, liquid adhesives as well as other liquid chemicals present similar problems when dispensed through a tube.

Accordingly, it is an important object of this invention to provide a simple, inexpensive expedient for receiving and temporarily supporting liquid sprayers between dispensing operations. The prior art is further represented by the following patents: U.S. Pat. Nos. 1,039,335, 1,566,597, 1,611,259, 2,641,385, 4,446,994, 2,741,406, 2,987,228, 5,058,783, 5,107,909, 5,584,345, and 5,887,767.

SUMMARY OF THE INVENTION

A method and apparatus for receiving a liquid dispensing tube and for temporarily accommodating the tube and positioning the sprayer in upright position during periods of non use include carrying a mounting member adjacent a spout or other opening at the top of a liquid container with the tube extending outwardly into the container for accommodating the tube while positioning the sprayer in an upright position when spraying activity is temporarily discontinued.

It is an important object of this invention to provide apparatus and method for accommodating a liquid dispensing tube extending into a liquid container while carrying a sprayer in upright position when the user is resting during a spraying operation.

Another important object of the invention is the provision of a sprayer mounting clip which is readily attached beneath a closure member at the top of a liquid container wherein a liquid dispensing tube passes through the closure member for connection at a lower end of a sprayer.

Still another object of this invention is the provision of a sprayer mounting clip of simple configuration permitting inexpensive fabrication as from molded or stamped plastic material or metal or by utilizing other suitable materials and techniques.

The sprayer retaining clip is easily installed for the convenience of the operator facilitating performance of an otherwise tedious spraying sequence.

While this invention is exemplified in connection with a garden sprayer it is expected that the apparatus and method may be adopted to other uses in liquid dispensing applications.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a retainer for a sprayer carried at one end of a tube through which liquid is dispensed from a container. The tube is carried intermediate its ends by a closure member at the top of the container and extends into the liquid at the other end. A mounting member A is secured to the container by the closure member when in closed position on the container and is removable when the closure member is in open position. A receiving member B is carried by the mounting member in opposed relation thereto. A lateral passageway C opens into the receiving member permitting passage of the tube therethrough facilitating reception and positioning of the nozzle by the receiving member. Thus, the sprayer is receivable by the receiving member with the tube remaining extended into the liquid during periods of non use.

The mounting member is preferably a closed loop confined beneath the closure member. The receiving member is also preferably a loop closed except for the lateral passageway through which the tube passes or is received. The mounting member and the receiving member preferably are formed within a flat unitary plastic clip wherein the mounting member and the receiving member are circular opposed loops joined integrally by a neck generally in the shape of the numeral 8. The method contemplates temporarily resting the sprayer upon the receiving member without removing the tube from the liquid during periods of non use of the sprayer.

Figure 1:
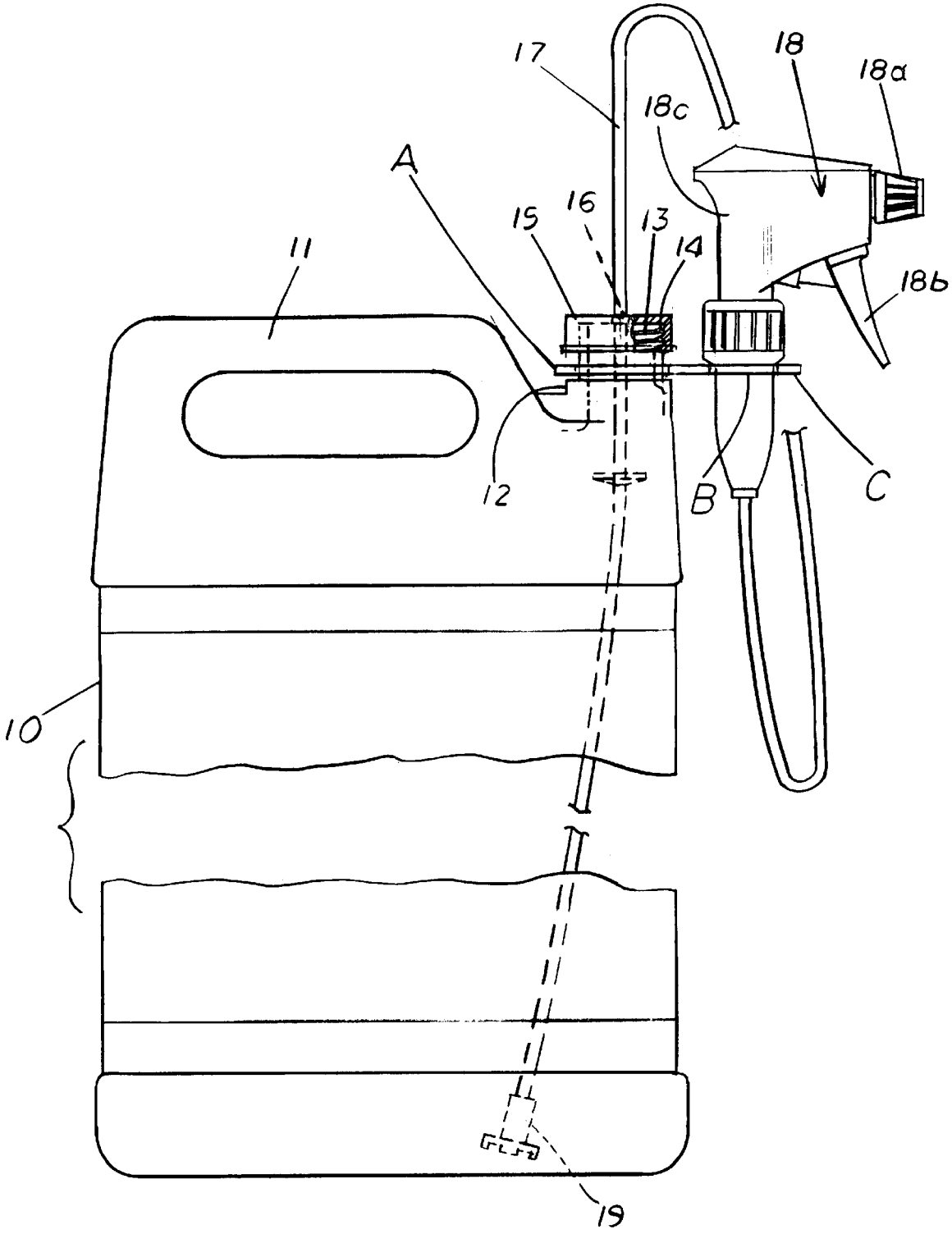
FIG. 1 is a side elevation, with parts broken away for clarity illustrating a liquid container having a handle extending across the top toward a threaded pouring spout receiving a threaded cap through which a dispensing tube passes for communication with a sprayer carried by a retaining clip constructed in accordance with the invention.

Referring more particularly to FIG. 1, a rectangular container suitable for holding liquids, powder or other media as may, for example, be useful in gardening is illustrated as at 10. The rectangular container has a closed top incorporating a handle 11 extending thereacross. The handle extends toward an upturned spout designated at 12 with a reduced threaded upper end 13 for receiving the internal threads 14 within a cap or closure member 15. The cap 15 is thus threadably positioned for securement in sealing relation at the top of the liquid spout for easy removal. The top 15 has a central opening at 16 for receiving a liquid dispensing tube 17. The liquid dispensing tube is illustrated as extending into the container adjacent the bottom for supplying liquid through the tube 17 to a dispensing apparatus such as a sprayer broadly designated at 18. The sprayer has a nozzle

18*a* and includes a trigger 18*b* carried by the housing 18*c* for pumping liquid into the nozzle. A support 19 positions a lower end of the tube 17 in spaced relation to a bottom of the container. Other suitable dispensing apparatus may include other nozzles and orifices of any suitable variety.

Figure 2:
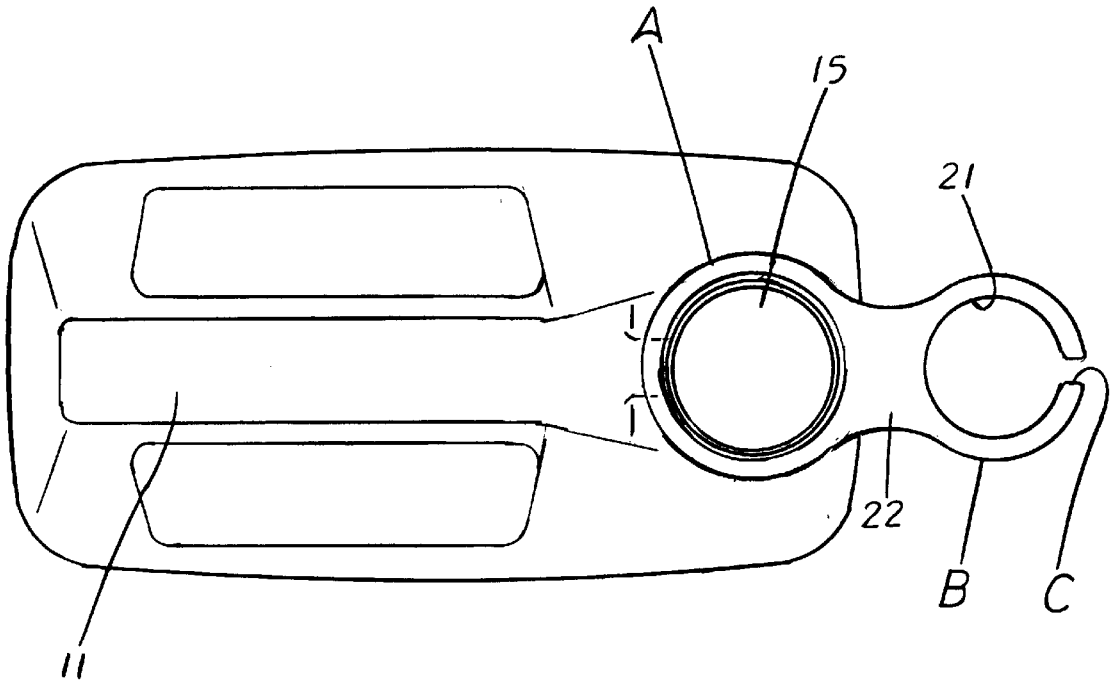
FIG. 2 is a top plan view further illustrating the container with the retaining clip in position for receiving the sprayer and accommodating the tube.
Figure 3:
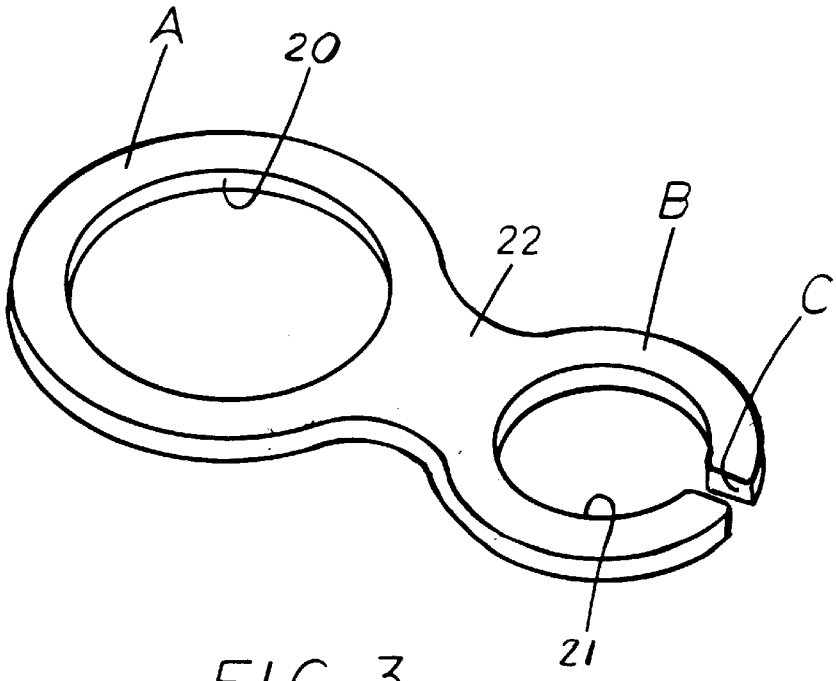
FIG. 3 is an enlarged perspective view illustrating a flat retaining clip looking toward a tube receiving passageway molded of plastic material in accordance with the invention.

FIGS. 2 and 3 further illustrate the mounting member A received upon the threaded reduced portion 13 at the upper end of the pouring spout as by a loose fit when the cap is closed. The mounting member A is generally donut-shaped and has an arcuate hole 20 therein. A receiving member B also has an arcuate opening 21 therein and is joined by a reduced neck member 22 opposite the mounting member A. The receiving member extends horizontally outwardly from the mounting member in cantilevered relation thereto. The receiving member is oriented so that the lateral passageway C is diametrically opposed to the mounting member A. While the clip may be manufactured by any suitable plastic molding process it is also possible that the retainer may be stamped from suitable material such as plastic or metal.

While a preferred embodiment of the invention has been described using specific terms, such description is for illustrative purposes only, and it is to be understood that changes and variations may be made without departing from the spirit or scope of the following claims.

What is claimed is:

1. A retainer for use with a sprayer that is carried at one end of a tube, the tube being carried by a closure member of a container that is capable of dispensing a liquid through the tube, said retainer comprising:

a mounting member defining a closed loop that is configured to be secured to the container adjacent the closure member of the container;

a receiving member that is carried by said mounting member in opposed relation thereto, said receiving member being configured to receive the sprayer in a substantially upright position during periods of non-use; and wherein said mounting member and said receiving member form a flat, unitary clip.

2. A retainer as defined in claim 1, wherein said receiving member also defines a passageway opening configured to permit the passage of the tube therethrough.

3. A retainer as defined in claim 2, wherein said receiving member is a loop that is closed except for said passageway opening.

4. A retainer as defined in claim 1, wherein said unitary clip is plastic.

5. A retainer as defined in claim 1, wherein said mounting and receiving members are circular opposed loops joined integrally by a neck.

6. A retainer for use with a sprayer that is carried at one end of a tube, the tube being carried by a closure member of a container that is capable of dispensing a liquid through the tube, said retainer comprising:

a mounting member defining a closed loop that is configured to be secured to the container by the closure member of the container;

a receiving member that is carried integrally by said mounting member in opposed relation thereto, said receiving member being configured to receive the sprayer in a substantially upright position during periods of non-use, wherein said mounting member and said receiving members form a flat unitary clip; and a passageway opening defined by said receiving member that is configured to permit the passage of the tube therethrough.

7. A retainer as defined in claim 6, wherein said receiving member is a loop that is closed except for said passageway opening.

8. A retainer as defined in claim 6, wherein said unitary clip is plastic.

9. A retainer as defined in claim 6, wherein said mounting and receiving members are circular opposed loops joined integrally by a neck.

10. A method of utilizing a sprayer for dispensing chemicals for home and garden use, the sprayer being carried by one end of a tube that passes through a closure member of a dispensing container, said method comprising:

providing a receiving member for supporting the sprayer, said receiving member defining a lateral passageway opening configured to receive the tube;

removably positioning said receiving member upon the container by securing a mounting member adjacent the closure member, said mounting member defining a closed loop, wherein said receiving member is integrally carried by said mounting member in opposed relation thereto wherein said mounting and receiving members form a flat, unitary clip; and temporarily resting the sprayer upon said receiving member in a substantially upright position during periods of non-use of the sprayer.

11. A method as defined in claim 10, wherein the sprayer is temporarily rested upon said receiving member without removing the tube therefrom.

12. A method as defined in claim 10, wherein said unitary clip is plastic.

13. A method as defined in claim 10, wherein said mounting and receiving members are circular opposed loops joined integrally by a neck.

* * * * *